United States Patent [19]

Johnson

[11] Patent Number: 4,712,471

[45] Date of Patent: Dec. 15, 1987

[54] ACTUATOR LOCKING MECHANISM

[75] Inventor: D. Dale Johnson, Mt. Clemens, Mich.

[73] Assignee: Ex-Cell-O Corporation, Walled Lake, Mich.

[21] Appl. No.: 901,720

[22] Filed: Aug. 29, 1986

[51] Int. Cl.[4] ..... F15B 15/22

[52] U.S. Cl. ..... 92/24; 92/27

[58] Field of Search ..... 92/24, 25, 17, 20, 23, 92/27, 28; 285/315, 316

[56] References Cited

U.S. PATENT DOCUMENTS

| | | | |
|---|---|---|---|
| 3,039,794 | 6/1962 | De Cenzo | 285/316 X |
| 3,397,620 | 8/1968 | Shelton et al. | 92/24 |
| 3,813,065 | 5/1974 | Hallsey et al. | 285/316 X |
| 3,863,961 | 2/1975 | Dinning | 285/316 X |
| 4,219,223 | 8/1980 | Schulte | 285/315 X |

FOREIGN PATENT DOCUMENTS

| | | | |
|---|---|---|---|
| 565127 | 10/1944 | United Kingdom | 92/24 |

*Primary Examiner*—Alan Cohan
*Assistant Examiner*—John C. Fox
*Attorney, Agent, or Firm*—John C. Evans

[57] ABSTRACT

A hydraulic actuator with reduced interior volume includes a locking mechanism engageable with the main ram of the actuator to hold it in a fully retracted position without backlash. The locking mechanism comprises three locking jaws that move synchronously in a radial direction between lock or unlock position. Each of the jaws engage a groove cut into a rod adjacent the piston head of the main ram; the jaws are cammed into a locking position by a conical sleeve actuated by hydraulic pressure under the control of the main control valve. Jaw deactivation is accomplished by an opposed pressure which disengages the conical sleeve and the jaws are then spring biased into a cammed open position as the main ram begins to extend. Springs located between the individual jaw segments assist the camming action for opening the jaws.

5 Claims, 5 Drawing Figures

ACTUATOR LOCKING MECHANISM

This invention relates to fluid pressure actuators and more particularly to such actuators of the type that include a selectively operated locking mechanism for holding the actuator ram in a retracted or extended position.

There are many operating situations where a fluid actuator is required to assume an operating position in which it is subjected to a substantial external loading. In such cases, when the loaded position is assumed by the actuator it is advantageous to provide a mechanical locking mechanism that will physically restrain the ram from movement from the operating position in which the external forces are operative thereon.

Various proposals have been suggested in the past to physically interlock the ram of a fluid actuator in a controlled position. One such actuator is shown in U.S. Pat. No. 3,008,454 which includes a pair of locking keys that are selectively positioned with respect to locking shoulders on opposite ends of the actuator cylinder to lock a main ram with respect to the cylinder in either a fully extended or fully retracted position. In the arrangement valving is included within the main ram to produce a locking action on the locking key. The valving requires a substantial modification of known main ram piston head configurations. A like fluid pressure actuator with locking means is set forth in U.S. Pat. No. 3,107,582 which includes cylinder bolts that serve as radially moveable locking detents. Again an internally formed valving mechanism is provided to produce the action that is required to shift the locking detents that cooperate with the locking shoulders on the cylinder of the actuator.

U.S. Pat. No. 3,177,780 has a actuator with a lock in the form of latch fingers which are latched to lock a cylinder in place by engagement with fore and aft lock rings. Auxiliary pistons are pressurized to bias the fingers into the lock position.

U.S. Pat. Nos. 3,251,278 and 3,451,313 disclose other cam lock arrangements of the latch finger biased plunger type.

U.S. Pat. No. 3,586,138 shows an actuator having a circumferential lock ring segment which is wedged against a piston rod by a separate lock motor.

U.S. Pat. No. 4,519,571 discloses an actuator having a lock for a well blowout preventer. The unit includes plural actuator rams each having a locking element controlled by a pressurized piston.

British Pat. No. 730257 shows a pressure actuator lock arrangement that includes rollers which are pressed apart by springs and the rollers in turn are wedged against flat surfaces on the piston to perform a locking operation thereon. The design is in the nature of an over running clutch mechanism and requires a separate screw type actuator.

While all of the aforesaid actuator cylinder lock mechanisms are suitable for their intended purpose they are configured to occupy actuator interior volume. As higher pressure hydraulic systems are specified for various applications such as advanced engine applications there is a requirement to reduce the weight of actuators and, because of the output force, and to provide thicker actuator walls which further reduces useable interior volume.

Accordingly, an object of the present invention is to provide a space efficient and reliable locking mechanism which can be readily incorporated in an advance system high pressure actuator with reduced useable interior volume.

Another object of the present invention is to provide a compact mechanical locking arrangement that will be operative within the confines of a limited useable interior volume of a high pressure actuator and to do so by modifying the head end of the actuator to include concentrically located opposed sleeves each carried within the head end of the actuator and reciprocated relative thereto by spring means; and wherein the sleeves selectively act on three equidistantly spaced locking jaws to drive the locking jaws into open and closed position with respect to a groove on a piston head extension.

Still another object of the present invention is to provide an improved hydraulic actuator including an actuator head to close one end of the actuator cylinder in which is carried a locking mechanism means that is operated to selectively move the plurality of locking jaws into closed or open positions for selectively engaging a groove in the main ram of the unit located adjacent its piston head.

BRIEF DESCRIPTION OF THE DRAWINGS

The foregoing and other objects, features and advantages of the invention will be apparent from the following detailed description of a preferred embodiment of the invention when taken in conjunction with the accompanying drawings wherein:

Referring now to FIG. 1 a fluid actuator 10 is illustrated including a ram 12 having a piston head 14 slidably supported for reciprocation within a cylinder 16. The cylinder 16 has a large diameter end 18 in which is sealingly located an actuator head 20. The head 20 is secured to the large diameter end 18 by suitable fastening means such as screws 22 and includes an inboard flange 24 that is in sealing engagement with an annular seal element 26. The opposite end of the cylinder 16 is formed as a small diameter extension 28 that includes a plurality of annular grooves 30,32,34,36 therein that receive axially located annular seal elements 38,40,42,43 all of which sealingly slidably engage the outside diameter 44 of the rod portion 46 of the main ram 12. The rod is connected at its outboard end to a support ring 48 with an internal bore 50 that is adapted to be connected to a moveable component that is operated by the fluid actuator 10.

Figure 1:
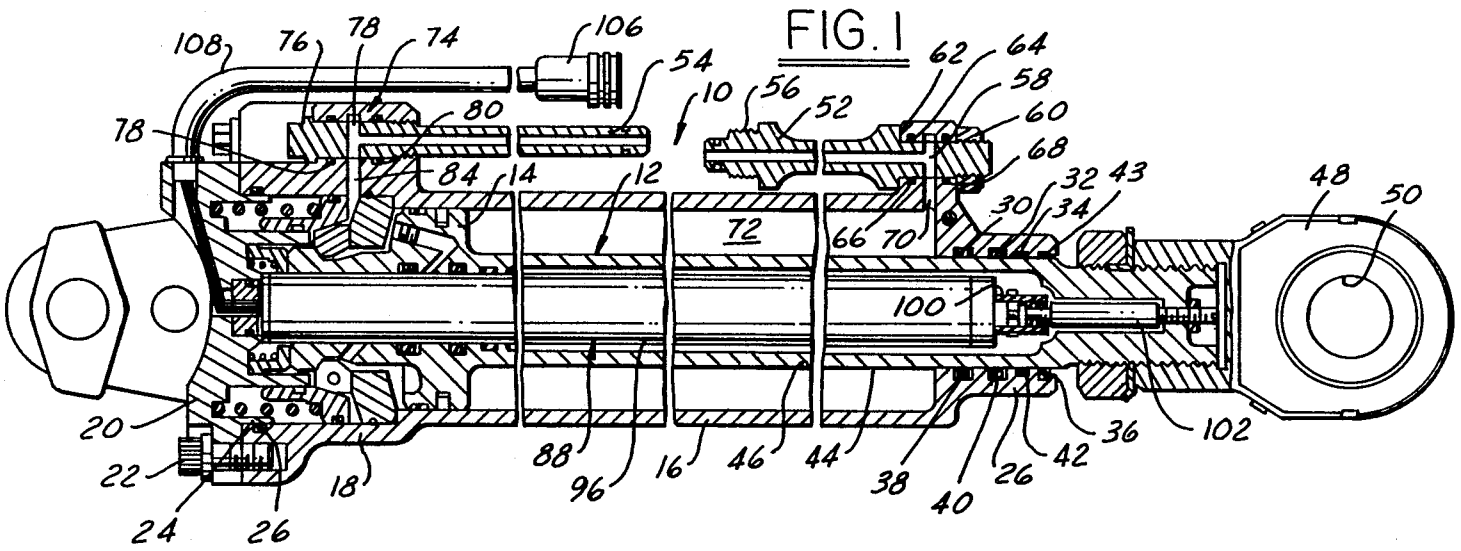
FIG. 1 is a sectional view of a fluid actuator including the present invention.

Fluid pressure is supplied to opposite ends of the piston head 14 through tubes 52,54. The tube 52 includes an inlet fitting 56 adapted to be connected to a suitable high pressure hydraulic supply. It includes a cross passage 58 therein which is located by means of a nut 60 threadably received on the end of the tube 52 so as to hold a locating shoulder 62 thereon against a seal housing 64 on the cylinder 16 at the outlet end thereof. The seal housing 64 includes suitable annular sealing elements 66,68 that seal against leakage whereby high pressure hydraulic fluid will be directed through an inlet passage 70 into a pressurizeable chamber 72 on one side of the piston head 14.

Figure 3:
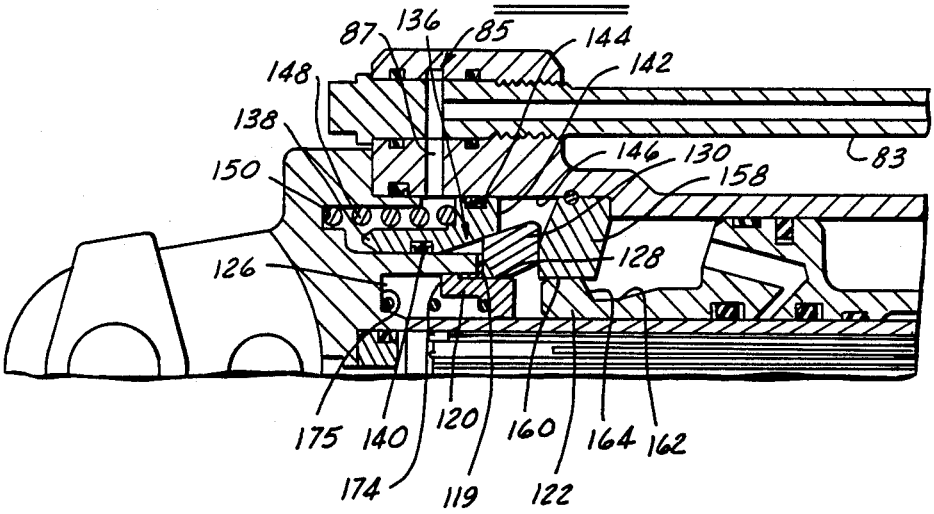
FIG. 3 is an enlarged fragmentary sectional view of the actuator shown in an open position.

The tube 54 is adapted to be connected to a pressure source at its inlet end. A seal assembly 74 engages the inboard end 76 of the tube 54 at two annular seals 78,80. The annular seals 78,80 prevent leakage from a cross passage 82 in the tube 54 which is in communication with an inlet opening 84 to a pressurizeable chamber 86 on the opposite side of the piston head 14. The tubes 52,54 are selectively connected to the hydraulic source by suitable control valves to produce either an inboard retraction of the main ram 12 into the cylinder 16 or an extension of the main ram 12 to an extended position exteriorly of the cylinder 16. Additionally, the unit is controlled by a vented return tube 83 communicating low pressure through a return tube seal housing 85 to return pressure port 87 (FIG. 3).

The fluid actuator 10 further includes an internally located position transducer 88 that is located through the piston head 14 and sealed with respect thereto by spaced annular seals 90,92 carried on the inside of a bore 94 formed through the piston head 14 and through the piston rod 46. The transducer 88 has an outer cylinder 96 connected at its head 98 to the head 20. It further includes a sliding rod 100 that is telescopingly received within the cylinder 96 for reciprocation with respect thereto in response to reciprocating movement of the piston rod. The moveable rod 100 is fixedly connected to the outboard end of the main ram by a fastener assembly 102. The transducer is of the type that includes coils that are arranged to produce an output signal in accordance with the relative position of the moveable tube 100 with respect to the fixed outer cylinder 96. The coils are energized from a suitable source through a wire bundle 104 that is connected at an electrical plug 106 on the end of a wire conduit 108 that is connected to the head 20 and configured to be in spaced parallelism to the outer surface of the cylinder 16 as best seen in FIG. 1.

In accordance with the present invention a improved actuator lock assembly 110 is disposed within the confines of the large diameter end 18 of the cylinder 16 and the actuator head 20. The actuator head also includes a ring connector 112 thereon for relative movement with the mounting ring 48 to cause operation of an actuated unit connected thereto. In many cases actuators of the illustrated type are required to be space efficient and of low weight. Furthermore, they require operating pressures in the order of 8000 psi which also requires that the actuator size be smaller as compared to actuators that operate in lower pressures for example in the order of 3000 psi. The actuators operating in the 8000 psi range require thicker actuator walls that reduce the interior space available within the unit for purposes of the lock assembly function.

In order to utilize the limited space available within such actuator interiors the present invention includes a tubular inboard extension 116 with an O.D. surface 118 thereon which is located axially within the axial length of the large diameter end 18 of the cylinder 16. The extension 116 carries an insert 119. The insert 119 serves as a stop for a first spring biased sleeve 120 that is selectively engageable with the inboard end 122 of the main ram 12. The sleeve more particularly includes a bent end 124 having a annular surface area exposed to the end 122 to provide a surface for moving the sleeve 120 into a release cavity 126 formed inside the inboard extension 116. The sleeve 120 has an outside diameter surface 128 thereon that supports a plurality of locking jaws 130,132,134 in a radially outwardly located locking jaw open position to be described. The previously described insert 119 also serves as a guide for the locking jaws.

Additionaly, the locking mechanism 110 includes a second sleeve 136 with a tubular end 138 slidably received on the outside diameter 118. The sleeve end 138 carries an annular seal 140 that seals against the O.D. surface 118. The opposite large diameter end 142 of the sleeve 136 includes a annular seal 144 that sliding sealingly engages the inside surface of a bore 146 through the large diameter end 118. The sleeve 136 is spring biased toward the locking jaws 130 through 134 by a compression spring 148 havine one end seated in an annular groove 150 of the head 20 of the opposite end thereof an engagement with the large diameter end 142.

The second sleeve 136 further includes a conical surface 152 thereon that overlies inclined surface 154 on each of the locking jaws. The conical surface 152 thereby serves to concurrently move each of the locking jaws 130,132,134 in a radially inwardly located direction which will cause a inboard arcuate surface 156 on each of the jaws to be securely held against the outside diameter 128 of the release sleeve 120.

Additionally, the lock assembly includes an annular abutment member 158 that has a inside bore 160 therethrough through which the inboard end 122 of the main ram 12 is free to travel. The main ram includes an annular locking groove 162 therein defined in part by a conical surface 164 that is engageable with a second conical surface 166 on the outboard face of each of the locking jaws 130,132,134.

Each of the locking jaws are spring biased into a radially outwardly located open position as shown in FIG. 3 by biasing springs 168 which are located between each of the jaws and connected to tabs 170,172 formed on the opposite end of each of the jaws.

Figure 4:
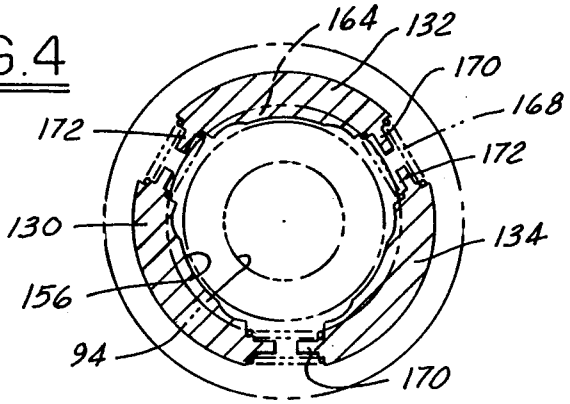
FIG. 4 is a sectional view of locking jaw components of the present invention in the closed position.
Figure 2:
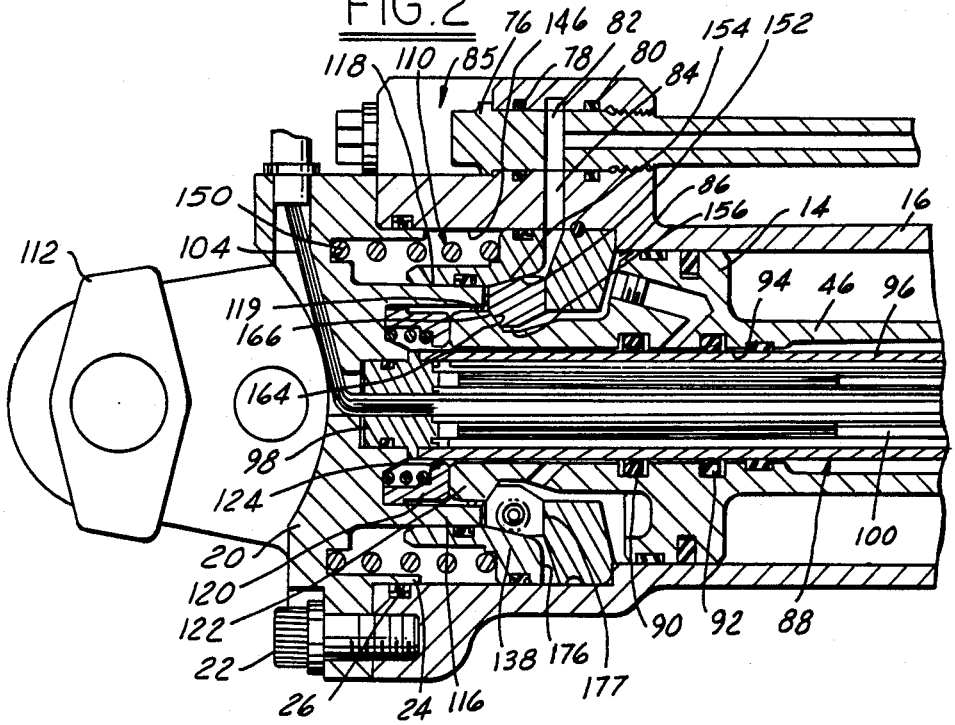
FIG. 2 is an enlarged fragmentary view of a actuator lock mechanism of the present invention shown in a closed position.

In operation, the locking mechanism 110 is maintained in an open position so long as release sleeve 120 underlies the locking jaws 130 through 134 as shown in FIG. 3. In order to lock the main ram 12, the main control valve will direct hydraulic fluid through the tube 52 into the pressurizeable chamber 72 so as to cause the piston head 12 to be moved to the head end of the actuator. Eventually the inboard end 122 will engage the face of the bent end 124 of the release sleeve 120 and cause it to shift into the release cavity 126. At this point the arcuate surfaces 156 are no longer supported by the outside diameter of the release sleeve 120 and the spring biasing action of the spring 148 on the locking sleeve 142 will cause it to move so as to shift the conical surface 152 thereon into engagement with the inclined surfaces 154 thereby to move the locking jaws radially inwardly into the lock position shown in FIGS. 2 and 4. This action will not occur unless return pressure is directed through port 84 to cavity 86. Since pressure on the opposite end of sleeve 136 is at return pressure, the sleeve 136 has equal low pressure on each side and spring 148 will act to lock the jaws. As the main ram 12 retracts inboard of the unit, it moves sleeve 124 out of the way of the locking jaws and they are cammed into the groove 162. Each of the jaw biasing springs 168 are compressed and the conical surface 166 on each of the jaws will be held against the conical surface 164 of the inboard end 122. The surfaces are configured and dimensioned so that the main ram 12 will be solidly held against the head 20 through a path defined by the locking jaws acting on the surface 164 to pull the ram end 122 against the suface of the bent end 124. The release sleeve 120 will thereby bemoved until its inboard end 174 will engage a surface 175 on the head 20 to positively ground the main ram 12 hen it is in its closed lock position so as to eliminate backlash in the locked system. This reacts main ram motion in the retract direction only. The main ram is secured from extending by contact of surface 164 with locking jaw surface 166, through the locking jaws and against surface 177 which contacts the abutment member 158 which is reacted by the housing 16.

Figure 5:
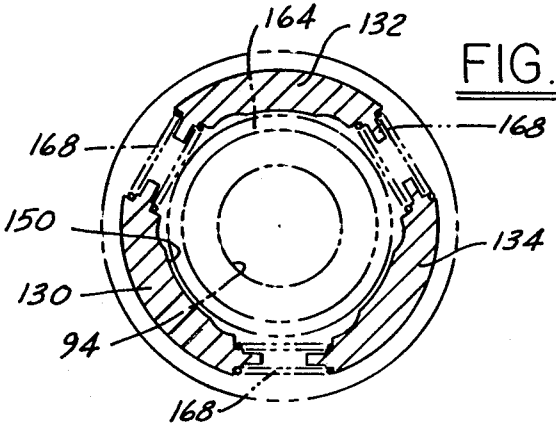
FIG. 5 is a sectional view of the locking jaws in FIG. 4 shown in an open position.

The locking jaws 130,132,134 are deactuated by pressurizing the inlet tube 54 by suitable control of the high pressure hydraulic system. The pressure will act against inboard surface 176 of the locking sleeve 138 to move it against the spring 148 until the conical surface 152 is no longer in engagement with the locking jaws. At this point the locking jaw spring 168 will separate them as shown in FIG. 5 into an open position and will cause the conical surface 166 to be cammed on the surface 164 into the open position as the main ram 12 begins to extend.

The advantage of the locking mechanism is that it is compactly located internally of the actuator apart from the main piston 14. Accordingly the main piston 14 is only required to carry seal elements to direct hydraulic fluid to operating pistons and the like for engaging lock plungers of the type previously known. Furthermore, the release sleeve 120 and the locking sleeve 138 are effectively telescoped on each other to further reduce the overall outside diameter of the locking mechanism so that it can be placed within units having a reduced outside diameter for reducing the size of the actuator while enabling the walls of the actuator to be increased in thickness. Furthermore, the reciprocating telescoped sleeves 120,136 of the locking mechanism 110 are configured and located with respect to locking jaws that are operated in a short stroke relationship with respect to the engaged surfaces of the main ram 12 so that the locking mechanism can be quickly engaged and disengaged from the main ram 12.

Finally, the configuration of the telescoping sleeves and the surfaces thereon enable the main ram to be fully grounded against the surface head so as to remove any backlash from the system so that when the actuator is locked it will positively hold the operating unit in a desired location without concern for variations in the hydraulic actuating pressure of the system. The locking mechanism further has the ability to perform reliable mechanical locking functions with fewer number of moving parts while retaining a space efficient assembly. The lock mechanism is configured further to assure that it will restrain ram motion at all loads up to the ultimate tension load of the ram until a pressure command is imposed thereon by a suitable control unit. Once the ram 12 is moved externally of the cylinder 16 the release sleeve will assume an underlying position with respect to the locking jaws 130 through 134 to position the locking mechanism for a subsequent engaging and disengaging operation.

The embodiments of the invention in which an exclusive property right or privilege is claimed are defined by the following claims.

I claim:

1. In a hydraulic actuator having an actuator cylinder with an actuator head and locking mechanism for locking a main ram in a retracted position, the impovement comprising: first and second slideable sleeve means, extension means on the actuator head extending axially inwardly of the actuator cylinder in telescoping relationship with said first and second sleeve means for slidably supporting said first and second sleeve means in a sliding referenced relationship on the actuator head at one end of the actuator cylinder;

said first sleeve means having a release position and an axially spaced locking position;

a plurality of moveable locking jaws located at the end of said extension at circumferentially spaced locations therearound, spring means connecting each of said locking jaws one to the other to spring bias said locking jaws radially outwardly into a release position;

each of said locking jaws having a first surface thereon including a load contact surface thereon;

said first sleeve means having a surface thereon selectively engageable with the load contact surface along a line of contact on each of said locking jaws to move the locking jaws into a locked position wherein the spring means are compressed;

each of said locking jaws having a second surface thereon that engages the main ram to hold it in a locked retracted position.

said main ram including an inboard end;

said inboard end engageable with said second sleeve means and operative to jam it into contact with the actuator head to eliminate all backlash between the main ram and the cylinder.

2. In the combination of claim 1, said extension means being a hollow cylinder, said first sleeve means having an end surface thereon and a sealing surface slidably supported on said extension means, said first sleeve means including an inclined annular surface thereon extending from the end of the sleeve means to the sealing surface thereon and coacting with said first surface on said locking jaws to maintain a line contact therebetween as the first sleeve means is moved into its locking position, said second sleeve means being located radially inwardly of said hollow cylinder, spring means for biasing said second sleeve means away from the actuator head to support said locking jaws in their released positions, and said second sleeve means being jammed against said spring means for engagement with the actuator head when said locking jaws are held by said first sleeve means in its locked position.

3. In the combination of claim 1, said first sleeve means including an inclined annular surface thereon coacting with said first surface on said locking jaws to maintain a line contact therebetween as the first sleeve is moved into its locking position, said locking jaws each having a third surface thereon engageable with the main ram to jam it against said second sleeve to force it into engagement with the actuator head so as to remove backlash between the main ram and the actuator head when the main ram is in its locked position.

4. In the combination of claim 1, a locator ring secured to the cylinder for positioning said locking jaws in an outboard direction, said extension means being a hollow cylinder having an end positioning said locking jaws in an inboard direction, said second sleeve means being interposed below said locking jaws when they are in their released position, said second sleeve means being shifted from below said locking jaws when the main ram is moved inboard to its retracted position thereby to clear a path for movement of said locking jaws into locked engagement with the main ram.

5. In the combination of claim 4, means forming a release cavity in the actuator head, said second sleeve means being located in said release cavity, means for spring biasing said second sleeve means outwardly of said release cavity when the main ram is moved from its retracted position, said second sleeve means being engaged by the main ram and positioned into said release cavity when the main ram is in its retracted position.

* * * * *